US006076292A

United States Patent [19]

Kawa

[11] Patent Number: 6,076,292

[45] Date of Patent: Jun. 20, 2000

[54] HYBRID GRAVE MARKER AND CREMAINS CONTAINER

[76] Inventor: Joseph Kawa, 33 Maple Ave., Catonsville, Md. 21228

[21] Appl. No.: 09/233,436

[22] Filed: Jan. 20, 1999

[51] Int. Cl.[7] ..... G09F 19/00; A61G 17/00

[52] U.S. Cl. ..... 40/124.5; 27/1; 52/140; 52/142; 312/114

[58] Field of Search ..... 40/124.5; 27/1; 52/139, 140, 142; D99/5; 277/316, 922; 312/114

[56] References Cited

U.S. PATENT DOCUMENTS

| | | | |
|---|---|---|---|
| D. 304,641 | 11/1989 | Bourassa . | |
| D. 345,848 | 4/1994 | May et al. . | |
| D. 355,065 | 1/1995 | Hicks . | |
| D. 359,831 | 6/1995 | Parker . | |
| D. 390,323 | 2/1998 | Parker et al. . | |
| D. 395,123 | 6/1998 | Barretto | D99/5 |
| 2,023,260 | 12/1935 | Beers et al. | 312/114 |
| 2,124,143 | 7/1938 | Long | 40/124.5 |
| 2,525,091 | 10/1950 | Brownawell . | |
| 3,346,310 | 10/1967 | Diack | 312/114 |
| 3,697,147 | 10/1972 | Schulte | 312/111 |
| 4,304,076 | 12/1981 | Splendora | 40/124.5 X |
| 4,324,026 | 4/1982 | Craft | 27/1 |
| 4,648,162 | 3/1987 | Daino . | |
| 4,750,793 | 6/1988 | Rioux, Sr. | 312/114 |
| 4,969,282 | 11/1990 | Eberhart | 52/306 X |
| 5,088,167 | 2/1992 | Rahe . | |
| 5,160,566 | 11/1992 | Ashby et al. | 52/306 X |
| 5,349,727 | 9/1994 | Niebergall . | |
| 5,393,253 | 2/1995 | Humble et al. . | |
| 5,625,933 | 5/1997 | Neuberger et al. . | |
| 5,647,108 | 7/1997 | Crook . | |
| 5,704,103 | 1/1998 | Crowley et al. . | |
| 5,729,921 | 3/1998 | Rojas . | |
| 5,732,452 | 3/1998 | Riedel, II | 27/1 |
| 5,794,318 | 8/1998 | Parker et al. . | |
| 5,853,235 | 12/1998 | Barnes | 312/114 X |
| 5,950,288 | 9/1999 | Bach Lahor | 27/1 |

FOREIGN PATENT DOCUMENTS

| | | | |
|---|---|---|---|
| 2264962 | 9/1993 | United Kingdom | 27/1 |

*Primary Examiner*—Terry Lee Melius
*Assistant Examiner*—Rodrigo J. Morales
*Attorney, Agent, or Firm*—Rosenberg, Klein & Lee

[57] ABSTRACT

A hybrid grave marker and cremains container includes a plurality of side walls, a transparent top cover, and a base, bonded to each other by ultraviolet glue so as to form a hermetic receiving envelope for containing ashes or memorabilia of a deceased person. The container is partially interred into the ground with the top portion of the container extending above the ground. Friends and relatives of the deceased may have the possibility of viewing the cremains contained in the container through the transparent top cover and/or side walls. The grave marker and cremains container may be used singly or may be combined with other cremains containers to form a memorial group.

9 Claims, 4 Drawing Sheets

HYBRID GRAVE MARKER AND CREMAINS CONTAINER

BACKGROUND OF THE INVENTION

1. Field of the Invention

The subject invention relates to burial markers, and more particularly to a hybrid grave marker and cremains container which is partially interred in the ground, and which contains ash of the deceased person, other once living beings, or any other memorabilia regarding the deceased which may be visible through the walls and top of the cremains container.

Even more particularly, the present invention relates to a hybrid grave marker and cremains container, where the container constitutes an airtight and watertight receiving envelope in which ashes or other memorabilia are protected against the influence of environment.

Furthermore, the present invention relates to a hybrid grave marker and cremains container which is assembled from glass pieces adhered to each other by glue hardening under influence of ultraviolet radiation with the junctures between the glass pieces sealed for better hermeticity.

The present invention also relates to a hybrid grave marker and cremains container which can be used singly or in clusters so that to form a memorial group for family members or otherwise related deceased.

2. Prior Art

There has been a variety of decorative memorials, and urns which can be stored indoors or outdoors. Usually, the decorative urns of varying shapes are placed in the niches and usually have glass covers placed over the openings of the niches for viewing purposes. Urns containing cremated remains are also stored outdoors in closed faced niches formed in vertical standing walls and in horizontally situated interment arrays. Various framed or modular structures for supporting urns have been developed but proved unduly expensive and complex to manufacture and construct.

Alternatively to the relatively expensive practice of storing ashes of deceased persons in wall compartments, ashes are placed into receptacles adapted to contain ashes, such as human or animal ashes, and intended to be at least partially embedded in the earth. For example, U.S. Pat. No. 5,647,108 discloses such a receptacle for ashes of deceased which have a compartment provided with an aperture for receiving the ashes. The receptacle also has a closure for sealing the aperture, and a support capable of supporting the receptacle in a vertical position in the earth. The closure which consists of a plaque is firmly attached to the compartment at the aperture thereof, so as to seal off the aperture by welding or the use of lugs. The support is a pointed stake, rigidly attached to the base end of the receptacle. The stake allows the receptacle to be embedded into the ground and to be supported in a vertical position. This form of the receptacle is relatively inexpensive to manufacture and, in addition, the moving of the receptacle from one place to another is easy due to the fact that the compartment is mounted on the pointed stake. The ashes, however, cannot be viewed through the walls or the top of the receptacle, as sometimes desired by relatives and friends of the deceased person. Additionally, embedding the receptacle in the ground solely by a stake member does not provide a stable foundation needed for a permanent burial marker.

U.S. Pat. No. 4,648,162 describes a stained glass cremation urn which is formed of a plurality of pieces of stained glass of harmonizing colors selected to provide an appealing combination of colors. The pieces of stained glass with a copper foil in place thereon are laid on a flat surface with a small spacing between them whereupon hot or molten lead is flowed over the joint. The heated lead is attracted by the copper foil so that a substantially linear surface of lead beading following the contours of the copper foil is provided along the junctures of the glass pieces, thereby securely clamping pieces of glass in place and providing a moisture and dustproof joint. The formed lead increases in thickness between the adjacently positioned pieces of glass and securely holds the stained glass parts in assembled relation. The assembled urn can be placed in any suitable location such, for example, as in the niche of a crematory or at any location in the home, or elsewhere as desired. This urn, however, is not constructed nor intended for being partially interred in the ground.

U.S. Pat. No. 5,729,921 describes a burial marker and display box for the preservation of memorabilia and/or ashes of an individual or individuals. An air-and-watertight container holds a second air-and-watertight container that is removable from the first one. The first container may be lockable so as to secure the contents therein. The second container is removable from the first container and includes a display window that allows visual inspection of the contents. The marker box is interred in the ground in a manner similar to a headstone, and allows visiting relatives and friends of the deceased to inspect the preserved memorabilia within the container. Ashes of an individual may also be carried by the container. Alternative embodiments allow several cylinder containers to be held in one single burial marker and display box. Although the overall assembly is intended as a hybrid burial marker and display box, it requires two independent and separate containers with each performing its individual function, i.e., the outer container serving as the burial marker, and the inner container serving as the ash receptacle. Therefore, the device fails to disclose a single structural element performing simultaneously the functions of a burial marker and cremains container. As can be seen, the burial marker and display box is somewhat expensive and complex, and needs a separate structural element for each functional requirement.

As can be readily appreciated from the relevant prior art discussed in previous paragraphs, despite many attempts, aesthetically pleasing, inexpensive ashes and/or memorabilia containers which simultaneously serve as grave markers and are partially buried in the ground through which ashes and memorabilia are visible for satisfying sentimental needs of friends and relatives of the deceased person is not seen in the prior art.

SUMMARY OF THE INVENTION

It is therefore an object of the present invention to provide an inexpensive and aesthetically pleasing device which functions simultaneously as a grave marker and cremains container to hold ash and/or memorabilia of a deceased person therewithin which is protected from moisture and dust contained in the atmosphere.

It is another object of the present invention to provide a hybrid grave marker and cremains container which is partially interred in the ground at any location desired and provides friends and relatives as well as any third parties the ability to possibly view the cremains of the deceased person or other contained memorabilia through the container.

It is still another object of the present invention to provide a hybrid grave marker and cremains container made of glass, wherein glass parts of the container are adhered each to the other by glue hardening under influence of ultraviolet radiation in order to provide long-lasting hermetic seal against the influence of environment.

It is still an object of the present invention to provide hybrid grave markers and cremains containers which may be arranged in a memorial group and which are secured to each other in predetermined mutual disposition thereof by UV (ultraviolet) glue or in a puzzle-like manner.

In accordance with the present invention, a hybrid grave marker and cremains container includes a plurality of transparent side walls made of glass, a transparent top cover assembled with these side walls and adhered thereto along the upper edges of the side walls, and a base affixed to the side walls along the lower edges thereof. This structure forms a receiving envelope which contains ashes or memorabilia of a deceased person.

Preferably, the side walls, the top cover, and the base, are held together by a UV (ultraviolet) glue which hardens under influence of ultraviolet radiation. The UV glue extends along the side edges of the side walls and along the upper and lower edges of the side walls, thereby substantially hermetically sealing the receiving envelope and preventing cremains from unwanted influence of the environment.

It is essential that the container is partially interred in the ground in order that the ashes contained within the container may be viewed through the top portion of the container extending above the ground.

The side walls, top cover, and the base or bottom cover are made of glass, which may be of any thickness or color, or the surface of which may be treated to achieve a desired surface appearance. The overall glass composition may be tempered and include beveled edges.

An indicia displaying information about the deceased person is positioned on one or several side walls of the container and may be made by means of etching, silk screening, painting, silvering, or some like method.

The container generally has a substantially rectangular or square cross-section and extends vertically above the ground with the top cover as well as any given edge constituting a beveled surface.

Preferably, a footing is provided at the bottom of the container to support the cremains container vertically.

The cremains containers can be clustered into a memorial group, where they are secured to each other in a predetermined mutual disposition thereof by the UV glue or in a puzzle-like manner.

These and other novel features and advantages of this invention will be fully understood from the following detailed description and the accompanying Drawings.

DETAILED DESCRIPTION OF THE PREFERRED EMBODIMENT

Figure 1:
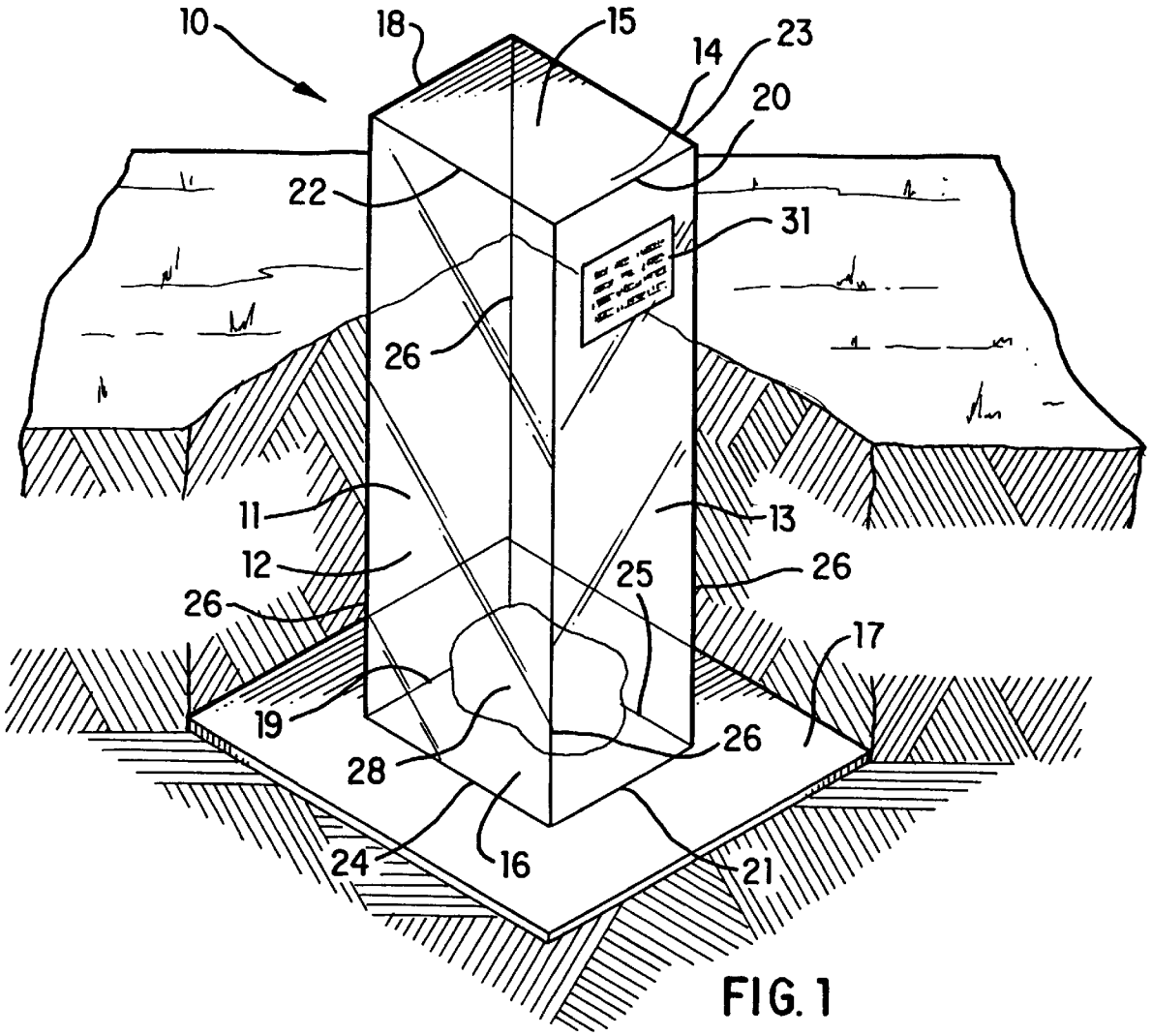
FIG. 1 is a perspective view of a hybrid grave marker and cremains container of the present invention partially buried into the ground.

Referring to FIG. 1, a hybrid grave marker and cremains container 10 includes four transparent side walls 11, 12, 13, and 14 formed of a glass composition, a transparent top cover 15 and a base 16. The top cover 15 and the base 16 are also generally formed of glass, similar to the side walls 11–14. A footing 17 is optionally provided to support the grave marker and cremains container 10, to provide stability to the entire structure 10, and to prevent unwanted vertical sinking or displacement of the grave marker and cremains container 10 when it is partially interred into the ground. The footing 17 may be formed from any suitable material which is rigid and can withstand natural causes of deterioration. This material composition may include plastic, stone, concrete, and the like compositions.

As seen in FIG. 1, the side walls 11 and 13 are substantially rectangular in shape with the upper edge 18 of the side wall 11 extending in parallel to the lower edge 19 thereof and with the upper edge 20 of the side wall 13 parallel to the lower edge 21 thereof. While the side walls 12 and 14 are of trapezoidal shape with the upper edge 22 of the side wall 12 and the upper edge 23 of the side wall 14 angled with respect to their respective lower edges 24 and 25.

The trapezoidal shape of the side walls 12 and 14 of the grave marker and cremains container 10 provides that the top cover 15 is positioned on the upper edges 18, 20, 22, and 23 and adhered thereto and preferably constitutes a beveled surface, thereby providing a more attractive and aesthetic appearance of the grave marker and cremains container 10 and increased convenience for friends and relatives of the deceased person to view the cremated remains or memorabilia of the deceased.

The side walls 11–14 are aligned and bonded therebetween along side edges 26 thereof by commercially available UV (ultraviolet) setting glue which hardens under the influence of ultraviolet radiation. UV glue 27 also is used for adhering the top cover 15 to the upper edges 18, 20, 22, and 23 of the side walls 11–14, as well as the base 16 to the lower edges 19, 21, 24, and 25 of the side walls 11–14.

Alternately, sidewalls 11–14 may be provided with substantially parallel upper and lower edges locationally defining the cover in a plane parallel to the base.

Figure 2:
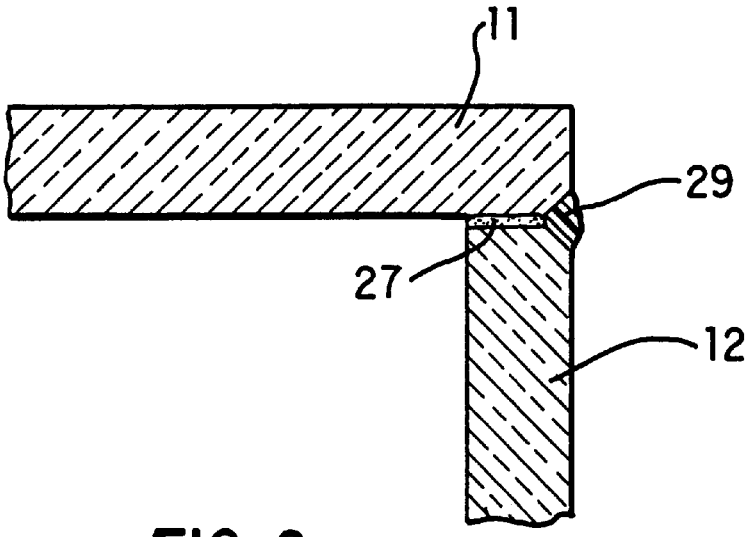
FIG. 2 shows a juncture between any two glass pieces adhered to each other by UV glue and covered by a sealant.
Figure 3:
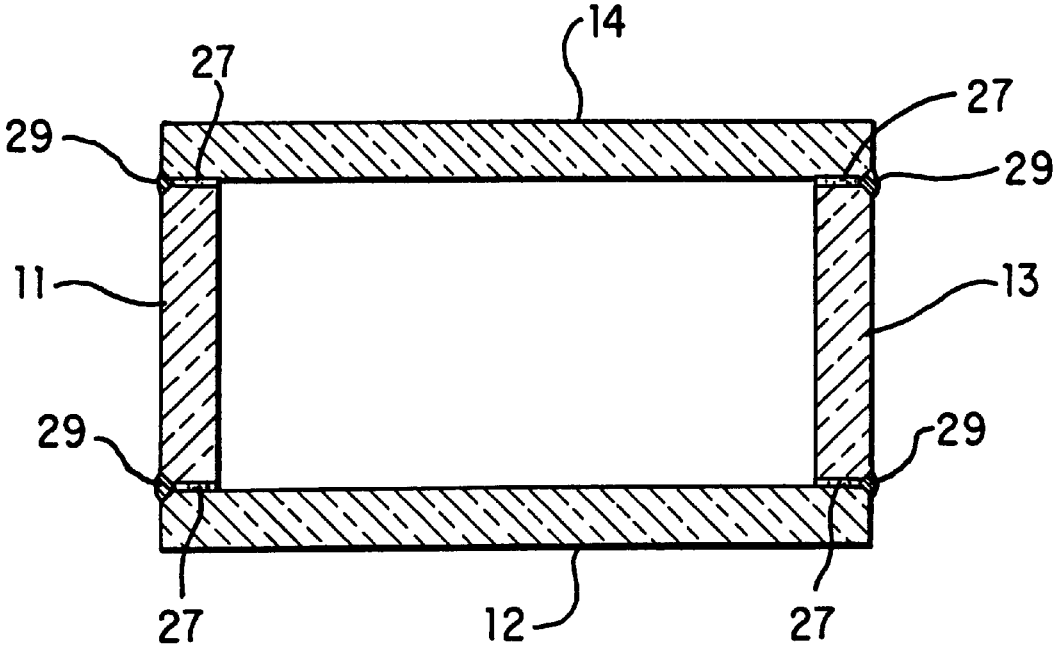
FIG. 3 shows a cross-section of the cremains container of the present invention.

As best shown in FIGS. 2 and 3 of the Drawings, the UV glue 27 extends at the junctures between glass pieces, i.e., along side edges 26, upper edges 18, 20, 22, 23, and lower edges 19, 21, 24, 25 of the side walls 11–14 and holds the overall structure of the grave marker and cremains container 10 together along all junctures of the structure, thereby forming a receiving envelope containing ashes, or memorabilia 28 therewithin.

To assemble the grave marker and cremains container 10 of the present invention, the side walls 11 and 14 are first assembled with their respective side edges 26 aligned and glued together by the UV glue 27, then the base 16 is adhered to the lower edges 19, 21, 24, and 25. Subsequently, the ashes or memorabilia 28 of the deceased person are introduced into the cremains container 10 through the opening formed on the top of the structure and bounded by the upper edges 18, 23, 20, and 22 of the side walls 11–14. Finally, the top cover 15 is positioned and glued to the upper edges 18, 20, 22 and 23 by the UV glue 27 to form a completely closed receptacle for ashes and memorabilia of the deceased person. In order to better prevent the ashes or memorabilia 28 contained within the grave marker and cremains container 10 from the influence of the external environment, the hermeticity of the receptacle or cremains container 10 is increased by a sealant 29 placed over and extending along all junctures of the overall structure and completely sealing the interior of the grave marker and cremains container 10 from unwanted influence of the water and dust contained in the atmosphere (for the top portion of the container extending above the ground) and from influence of water contained in the ground (for the lower part of the container 10 interred in the ground). In the preferred embodiment, the sealant 29 is a room temperature vulcanizing (RTV) sealant which may be silicone; however, other sealants known to those skilled in the art can be used for the purpose of increasing hermeticity of the grave marker and cremains container 10.

After the grave marker and cremains container 10 is assembled with ashes 28 received within, and top cover 15 is adhered to the upper edges 18, 20, 22, and 23 of the side walls 11 and 14, the sealant 29 is dispersed at the junctures of the structure and the unit is ready for partial interment into the ground alone or as a part of a memorial group, as will be described in further paragraphs.

As best shown in FIG. 1, the grave marker and cremains container 10 is partially buried in the ground, with approximately two-third of the length of the cremains container 10 being in the ground, and one-third extending above the ground. Although different dimensions can be used for the grave marker and cremains container 10, for the purposes of example only, and not for limiting the scope of protection covered by the present patent application, the length of the grave marker and cremains container 10 interred into the ground is approximately 30 inches, and the top portion extending above the ground is approximately 14 inches in height. Also, for the purposes of example only, the length of the upper edges 18 and 20 are approximately 4 inches, and the length of the upper edges 22 and 23 are approximately 6 inches.

It will be readily appreciated by those skilled in the art that glass of a variety of types, such as tempered, colors and thickness may be used for the grave marker and cremains container 10. Alternatively, side walls 11–14 or any other surface may be covered by a reflecting layer, thereby forming a mirror-like surface. The surface of the glass side walls 11–14 and top cover 15 may be treated by any technique known to those skilled in the art to achieve a desired appearance of the glass surface, for instance, etching, silk screening, painting, or gold leafing, etc. may be employed to distinguish or decorate the surface of the side walls 11–14 and top cover 15.

Figure 4:
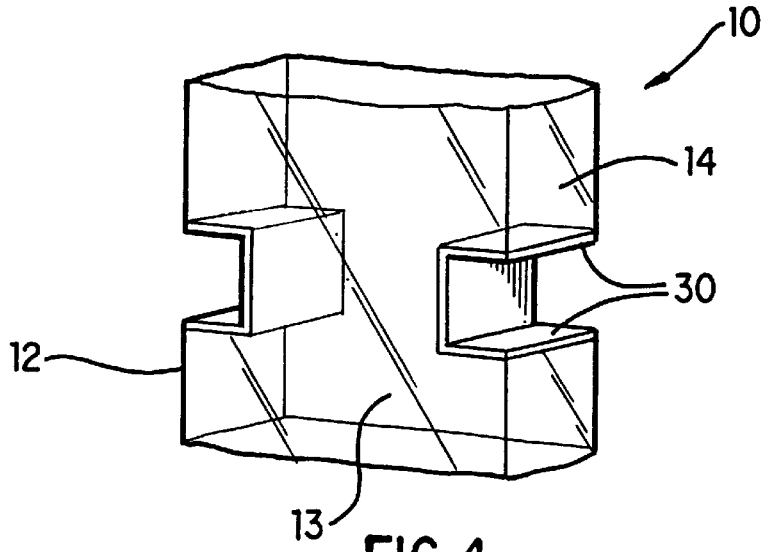
FIG. 4 shows an alternative embodiment of the hybrid grave marker and cremains container of the present invention.

It is also possible to cover the edges of the grave marker and cremains container 10 by strips of metal, as shown in FIG. 4, where metal strips 30 are positioned on the edges for decoration purposes and/or for achieving increased mechanical stability of the entire structure. Additionally, metal spray may be dispersed over desired areas on the grave marker and cremains container 10. As can be seen in FIG. 4, the side walls 11–14 of the grave marker and cremains container 10 may have different shape so as to achieve an enhanced aesthetic quality of the grave marker and cremains container 10.

As best shown in FIGS. 1 and 3, the grave marker and cremains container 10 has a generally rectangular or square cross-section for simplicity of assembling; however, other shapes of cross-section are also contemplated in the scope of the present patent application.

Indicia 31 disposed on the front, side wall 13, displays the name and dates of the deceased, and/or any other information regarding the deceased person. The indicia 31 which constitutes a display panel may be made of glass or bronze or any material desired, which can be transparent, mirrored, which can have a decorative image formed thereon, by silk screening, etching, or embossing.

Figure 5:
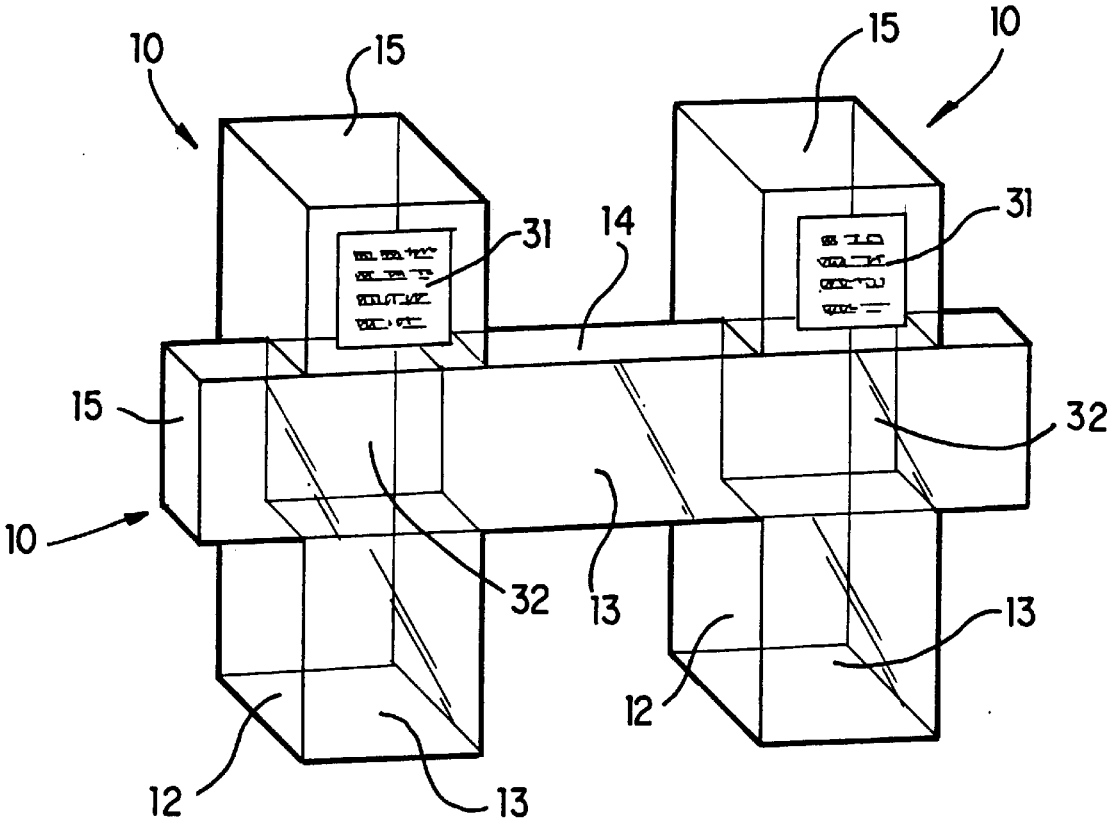
FIG. 5 shows a memorial group wherein the individual containers are joined to each other in puzzle-like manner.
Figure 6:
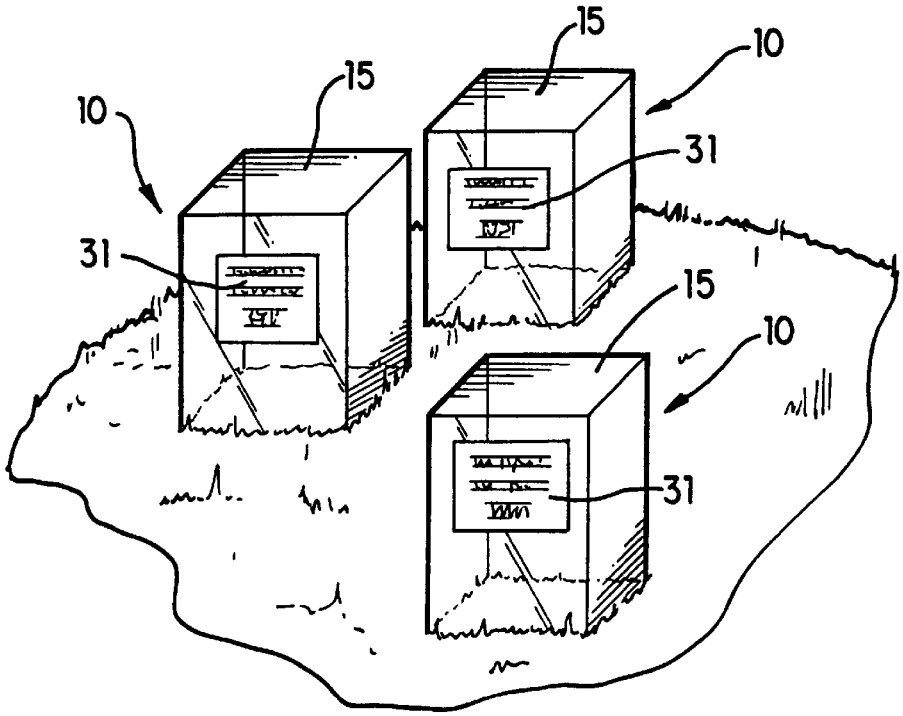
FIG. 6 shows another example of clustered containers to form a memorial group; and, FIG. 7 shows an alternative memorial group formed from individual cremains containers of the present invention.
Figure 7:
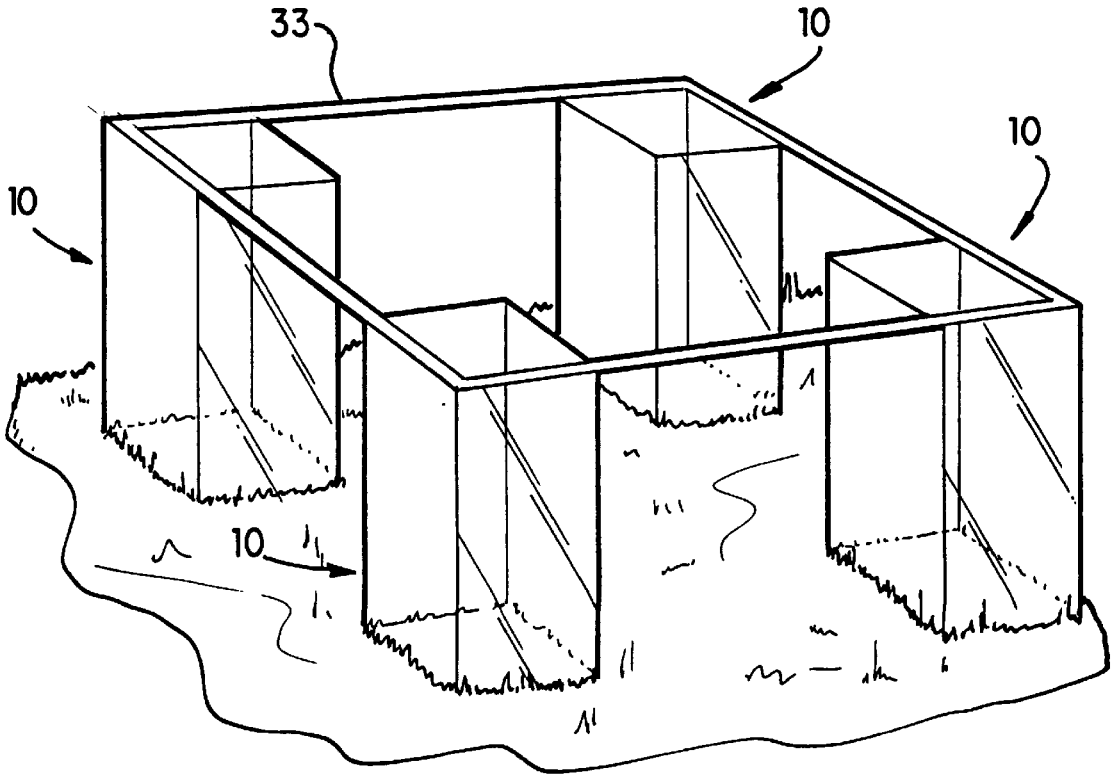

As best shown in FIGS. 5–7, individual grave markers and cremains containers 10 can be clustered to form a group memorial for family members or loved ones desired to be buried in proximity to each other. The individual containers 10 can be joined either by UV glue or by puzzle-like securing joints. One type puzzle-like joints is shown in FIG. 5. Two containers 10 are placed vertically, while the third container 10 is positioned horizontally with respect to the vertical containers 10 and is maintained within the recesses 32 provided on the side walls of the vertical containers 10. The horizontal container 10 may be glued to the vertical containers 10, or may be maintained within the recesses 32 where it fits tightly therewithin and due to gravity forces. The number of individual containers 10, mutual disposition thereof within the memorial group, and the way they are arranged with respect to each other is discretionary, and is not to be limited by the example shown in FIG. 5. As shown in FIGS. 6 and 7, the individual containers 10 may all be positioned vertically as clusters of individual containers, or may be disposed in a surrounding frame or structure 33, so that the overall ensemble constitutes a single memorial group.

The grave marker and cremains container 10, either alone, or as the memorial group, may be partially interred into the ground at any desired location, such as in a cemetery, back yard, or other location. The location is influenced by a designer of the grave marker of the present invention and ultimately determined by interested parties, relatives and friends of the deceased person(s).

The hybrid grave marker and cremains container 10 of the present invention brings a spiritual and aesthetic satisfaction to relatives and friends of the deceased by providing them with the ability to possibly view the memorabilia and remains of loved ones. Additionally, the attractive appearance of the grave markers gives to those viewing the container the feeling that the deceased human remains at rest with a vaulted ceiling to the world. In this manner, the bonds between the deceased and his or her friends and relatives established during the life of the deceased person are not broken by the death of the deceased person, since the sight through the top cover of the grave marker of the present invention allows them to sentimentally share changes they are going through with those who are deceased. Not only is the grave marker of the present invention spiritually and philosophically distinguished from others, it also provides an attractive, low cost, and simple in implementation grave marker and cremains container which prevents the remains or ashes or memorabilia of the deceased person(s) from influence of the environment.

Although this invention has been described in connection with specific forms and embodiments thereof, it will be appreciated that various modifications other than those discussed above may be resorted to without departing from the spirit or scope of the invention. For example, equivalent elements may be substituted for those specifically shown or described. Certain features may be used independently of other features and in certain cases, particular locations of elements may be reversed or interposed, all without departing from the spirit or scope of the invention as defined in the appended claims.

What is claimed is:

1. A hybrid grave marker and cremains container, comprising:

a plurality of side walls formed of glass, each having a pair of side edges, an upper edge and a lower edge, adjacent side edges of said side walls being aligned and bonded together, a transparent top cover assembled with said side walls and adhered thereto along said upper edges thereof, and a base affixed to said side walls along said lower edges thereof, thereby forming a receiving envelope for holding cremains therein;

a glue hardened under influence of ultraviolet radiation, said glue being disposed between overlapping portions of said side walls, top cover and base; and, a sealant composition disposed over junctures between (a) said adjacent side walls, (b) said plurality of side walls and said too cover, and (c) said plurality of side walls and said base, thereby substantially hermetically sealing said receiving envelope.

2. The hybrid grave marker and cremains container of claim 1, wherein said top cover has a beveled lower perimeter edge and said upper edge of each said side wall has a beveled outer edge portion, said beveled lower perimeter edge of said top cover and said beveled outer edge portion of each said side wall together form a groove for receiving said sealant composition therein.

3. The hybrid grave marker and cremains container of claim 1, where said side edges of each said side wall have beveled outer side edge portions, said beveled outer side edge portions of each of a pair of said adjacent side walls together forming a groove for receiving said sealant composition therein.

4. The hybrid grave marker and cremains container of claim 1, further including a footing for burial beneath an earthen surface, said base of said cremains container being supported on a top surface of said footing.

5. The hybrid grave marker and cremains container of claim 1, where said junctures have grooves into which said sealant composition is disposed, said grooves being formed by combination of beveled edge surfaces of corresponding adjacent edges of said side walls, said top cover and said base.

6. The hybrid grave marker and cremains container of claim 1 where said sealant composition is a silicone sealant.

7. A hybrid grave marker and cremains container memorial group comprising a plurality of receiving envelopes joined together and each having a respective cavity for receiving cremains therein, each of said receiving envelopes including:

(a) a plurality of side walls arranged in side by side relationship to form a tubular contour surrounding said cavity, each side wall having a pair of side edges, an upper edge and a lower edge, adjacent side edges of said side walls being aligned and bonded together;

(b) a transparent top cover assembled to said side walls and adhered thereto along said upper edges thereof;

a base affixed to said side walls along said lower edges thereof; and a glue hardened under influence of ultraviolet radiation, said glue extending along said side edges, and said upper and lower edges, thereby substantially hermetically sealing said receiving envelope, said plurality of receiving envelopes being secured to each other by said glue.

8. The hybrid grave marker and cremains container memorial group of claim 7, wherein at least one of said plurality of receiving envelopes has at least one recess formed in a side wall thereof and another of said plurality of receiving elements is positioned within said recess.

9. A hybrid grave marker and cremains container memorial group comprising:

a plurality of receiving envelopes formed of glass, each of said receiving envelopes having a respective cavity for receiving cremains therein; and, a frame surrounding said plurality of receiving envelopes and linking said receiving envelopes together, each of said receiving envelopes including:

(a) a plurality of side walls arranged in side by side relationship to form a tubular contour surrounding said cavity, each side wall having a pair of side edges, an upper edge and a lower edge, adjacent side edges of said side walls being aligned and bonded together;

(b) a top cover assembled to said side walls and adhered thereto along said upper edges thereof; and, a base affixed to said side walls along said lower edges thereof to substantially hermetically seal cremains within said cavity; and, a glue hardened under influence of ultraviolet radiation, said glue being disposed between overlapping portions of said side walls, top cover and base.

* * * * *